US006021890A

United States Patent [19]

Focke et al.

[11] Patent Number: 6,021,890

[45] Date of Patent: Feb. 8, 2000

[54] BUNDLE PACK AND PROCESS AND APPARATUS FOR PRODUCING SAME

[76] Inventors: Heinz Focke, Moorstrasse 64; Harald Gosebruch, Bügermeister-Urban-Strasse 11, both of 27283 Verden; Hugo Mutschall, Deelsener Strasse 6, 273o8 Kirchlinteln, all of Germany

[21] Appl. No.: 08/838,439

[22] Filed: Apr. 7, 1997

[30] Foreign Application Priority Data

Apr. 23, 1996 [DE] Germany ..... 196 16 153

[51] Int. Cl.[7] ..... B65D 71/00

[52] U.S. Cl. ..... 206/83.5; 53/399; 206/391

[58] Field of Search ..... 53/399; 206/83.5, 206/139, 386, 391, 393, 394, 430, 432, 442, 497, 499, 597

[56] References Cited

U.S. PATENT DOCUMENTS

| | | | |
|---|---|---|---|
| 2,062,539 | 12/1936 | Vogt | 206/499 |
| 2,566,385 | 9/1951 | Van Patten | 206/597 |
| 2,741,885 | 4/1956 | Allison | 53/198 |
| 3,447,675 | 6/1969 | Kirby | 206/432 |
| 3,460,671 | 8/1969 | Harm | 206/391 |
| 3,515,272 | 6/1970 | von Gal | 203/65 |
| 3,568,591 | 3/1971 | Dunlap | 100/4 |
| 3,902,992 | 9/1975 | Schuster | 206/162 |
| 3,906,591 | 9/1975 | Bioardi | 206/83.5 |
| 3,987,901 | 10/1976 | Dullinger | 206/451 |
| 4,075,815 | 2/1978 | Carver, Jr. et al. | 53/32 |
| 4,079,566 | 3/1978 | Stoecklin | 53/399 |
| 4,444,311 | 4/1984 | Rias | 206/391 |
| 4,596,330 | 6/1986 | Benno | 206/497 |
| 4,880,115 | 11/1989 | Chaussadas | 206/427 |
| 4,886,167 | 12/1989 | Dearwester | 206/391 |
| 5,129,211 | 7/1992 | Anderson | 206/391 |
| 5,314,557 | 5/1994 | Schwartz et al. | 53/399 |

FOREIGN PATENT DOCUMENTS

| | | |
|---|---|---|
| 0612661A | 8/1994 | European Pat. Off. . |
| 1590202 | 5/1970 | France . |
| 2286763A1 | 4/1976 | France . |
| 1586924A | 10/1970 | Germany . |
| 2748541A1 | 10/1977 | Germany . |
| 4120925A | 1/1993 | Germany . |
| 4138138A | 4/1993 | Germany . |
| 9412648U1 | 8/1994 | Germany . |
| 08002548A | 1/1996 | Japan . |
| 2139175A | 11/1984 | United Kingdom . |
| 2261648A | 5/1993 | United Kingdom . |

*Primary Examiner*—Jim Foster

[57] ABSTRACT

Bundle packs are usually provided with a complete outer wrapping of a group of articles (33). This type of bundle pack is expensive in terms of material consumption. In the present case, the bundle group (33) is surrounded by two intersecting tapes (17, 18). These tapes (17, 18) are positioned such that they sufficiently surround and hold together a plurality of individual articles or packaging units (26) of the group of articles (33).

10 Claims, 10 Drawing Sheets

44
65
30
61
44
64
42/58
63
33
17
38
21
50
65
64
63
66
66
68
69
70
68
68
67
72/73
71

BUNDLE PACK AND PROCESS AND APPARATUS FOR PRODUCING SAME

DESCRIPTION

The invention relates to a bundle pack comprising a plurality of articles, especially individual packs arranged next to one another in at least one layer. Furthermore, the invention relates to a process and an apparatus for producing such bundle packs.

Bundles are a widespread type of a packaging for groups of individual articles, especially (small) packs, such as food packages, cigarette packs, paper-tissue packs, etc. The small or individual packs are combined to form ordered groups, usually in layers. In the hitherto known bundle packs, the group of small or individual packs is surrounded by a large container, for example made of cardboard or corrugated cardboard. The hitherto conventional bundle packs are, therefore, expensive in terms of material consumption.

The invention is based on the object to propose new bundle packs which require substantially less material. Furthermore, the invention relates to an economical or industrial production of such bundle packs.

To attain this object, the pack according to the invention is characterized in that the group of articles or individual packs is combined to a unit by at least one circumferential strip shaped tape which surrounds the layer or the layers of articles or individual packs on the outside.

The articles or individual packs are provided with their own wrapping made from paper, cardboard or (plastic) film. The unit of a group of such individual packs is formed by at least one tape which surrounds the layer or the group.

According to the invention, further simple packaging-technological measures are provided for an improved hold of the bundle which consolidate the relative position of the individual packs within the group. On the one hand, articles or individual packs may be connected to one another by glue spots or glue points, in the case of one layer of individual packs especially those individual packs which are positioned inside said layer and which do not immediately butt against the tape. The glue is preferably a known pressure-sensitive adhesive which makes possible an easy disconnection of the individual packs when dividing the bundle.

Alternatively or additionally, the group of individual packs may be surrounded by at least one further, second tape which extends transversely to the first tape and thus surrounds it crosswise.

A bundle pack according to the invention with two intersecting tapes is particularly advantageous for packaging cylindrical articles, such as paper rolls (kitchen paper, toilet paper). In this case, two respective rolls are combined to one packaging unit by a (foil) wrapping. These are combined in a plurality of layers, two rows of rolls or packaging units preferably resting next to one another in axial direction of the rolls. The tapes are arranged and dimensioned such that they centrally partly overlap the two adjacent rows in each case. In an advantageous embodiment, the tapes extend almost over the entire width or length of the group.

A bundle pack in which the intersecting (two) tapes are positioned such that the inner tape extends transverse-axially to the aligned cylindrical articles, whereas the outer, intersecting tape extends with two (upper and lower) legs parallel to the axes of the cylindrical articles, is particularly advantageous. The tapes are expediently wrapped around the group of articles under increased tension, such that the tapes cling to the outer cylindrical articles in a wavelike manner.

In the process according to the invention for producing such tapes, the group of articles is first conveyed in one direction through the vertical plane of a blank for the tape held ready in this plane and then, in the transverse direction, through the vertical plane of a second tape, the tapes successively adjoining the group of articles in a U-shaped manner. The respective tape is completely wrapped around the group of articles by means of further folding members. The ends of the tapes are connected to one another, in particular by sealing (in the case of plastic films) or by adhesive bonding.

An apparatus according to the invention is provided with at least two conveying tracks for the groups of articles, namely pack tracks, which are arranged at a right angle relative to one another. In the region of the pack tracks, folding members are positioned stationarily which each hold ready blanks for the tapes and wrap them around the groups of articles.

Further features of the invention are subject matter of the patent claims and will be explained hereinbelow with reference to the exemplary embodiments shown in the drawings. In these:

Figure 3:
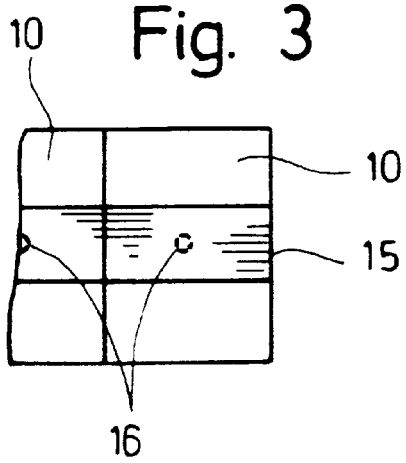
Figure 4:
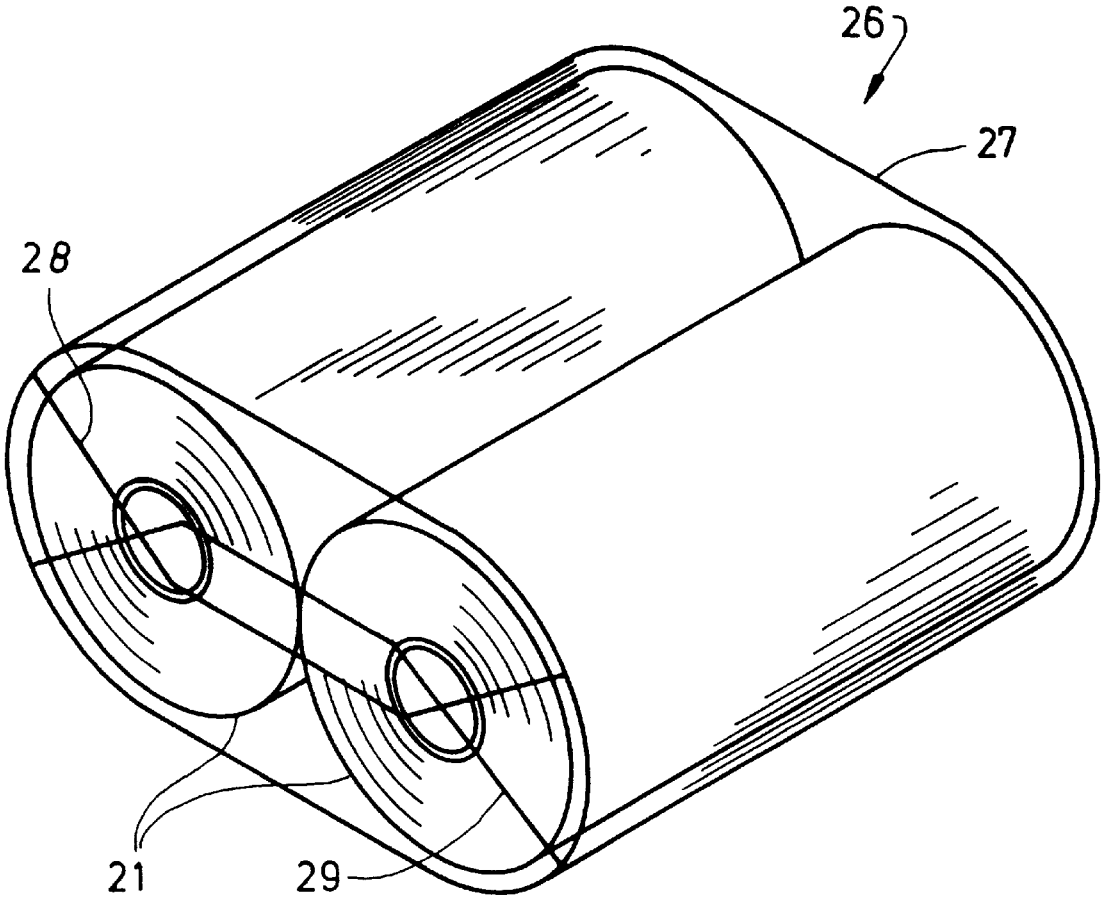
Figure 5:
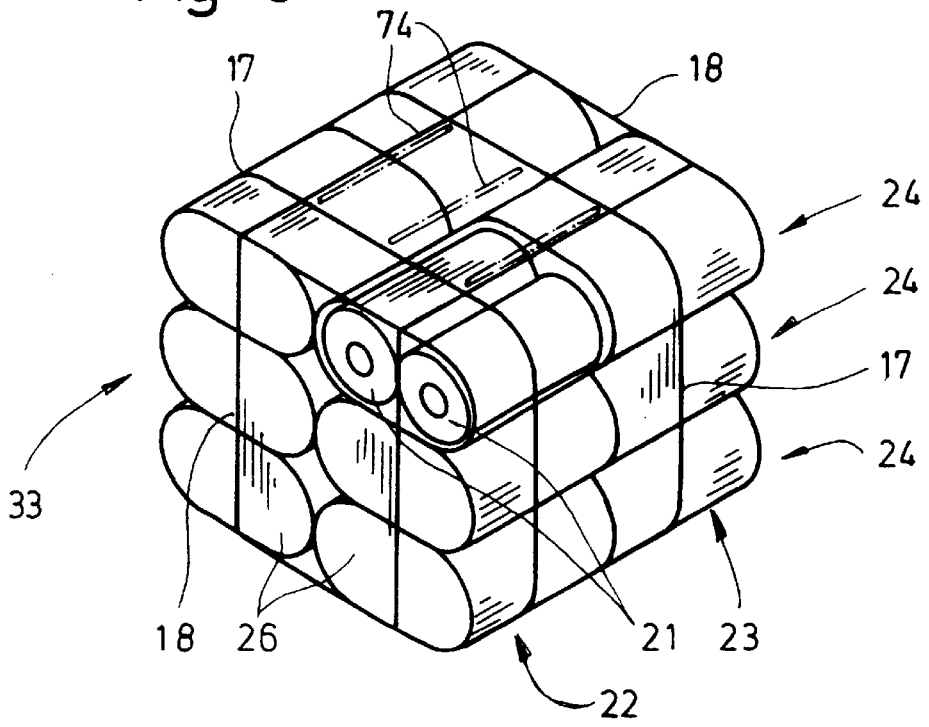
Figure 6:
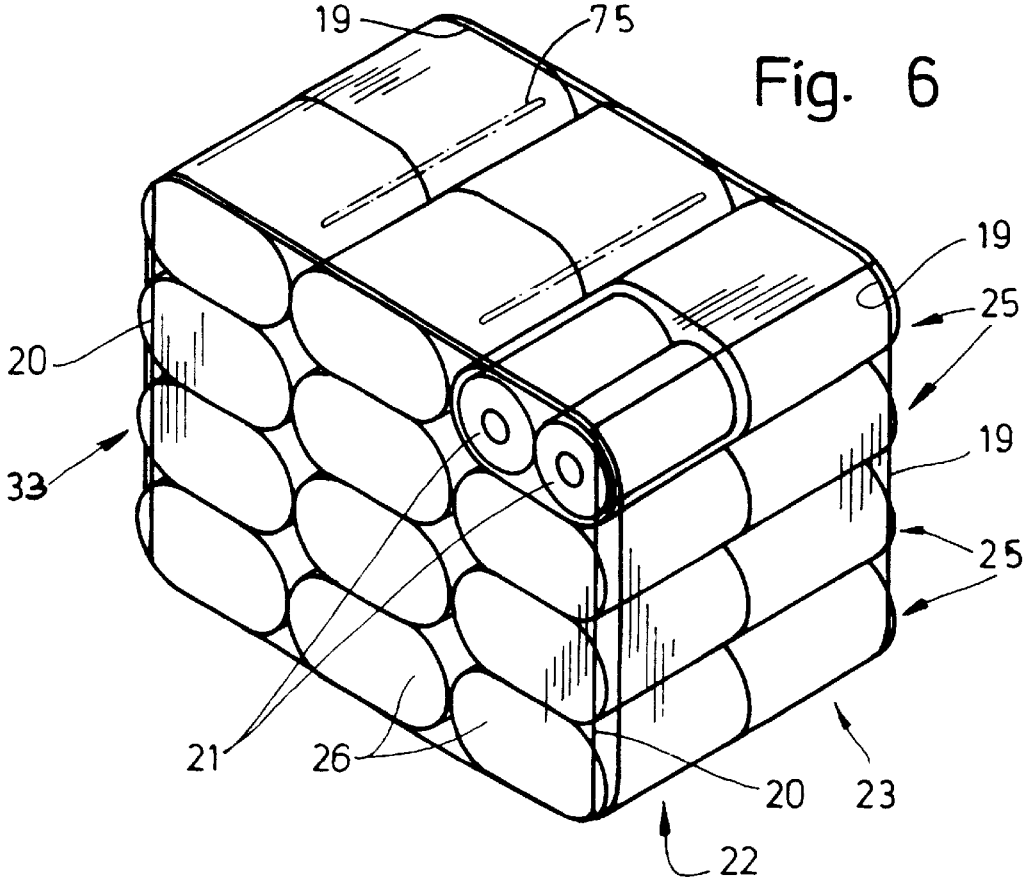
Figure 7:
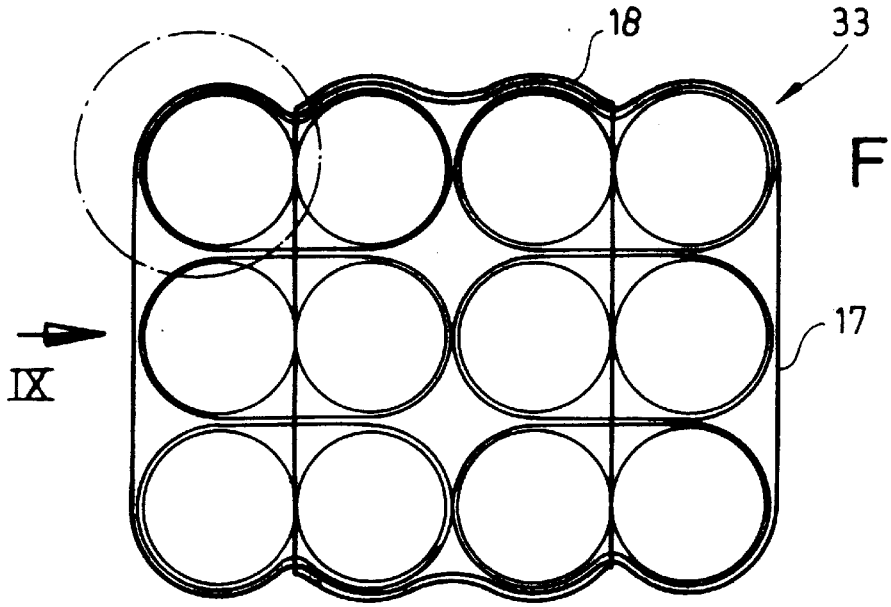
Figure 8:
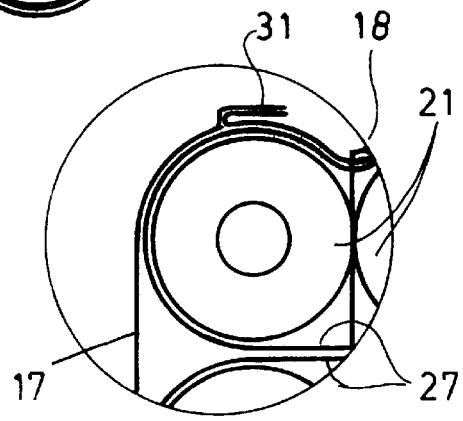
Figure 9:
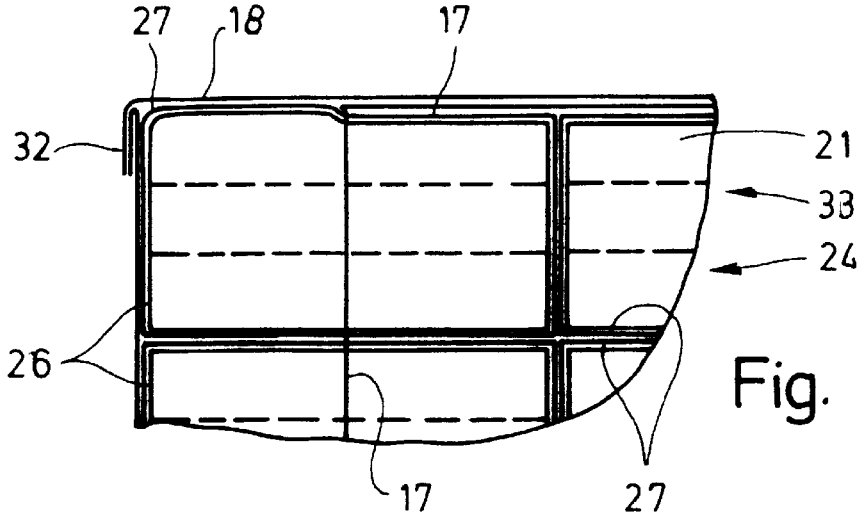
Figure 10:
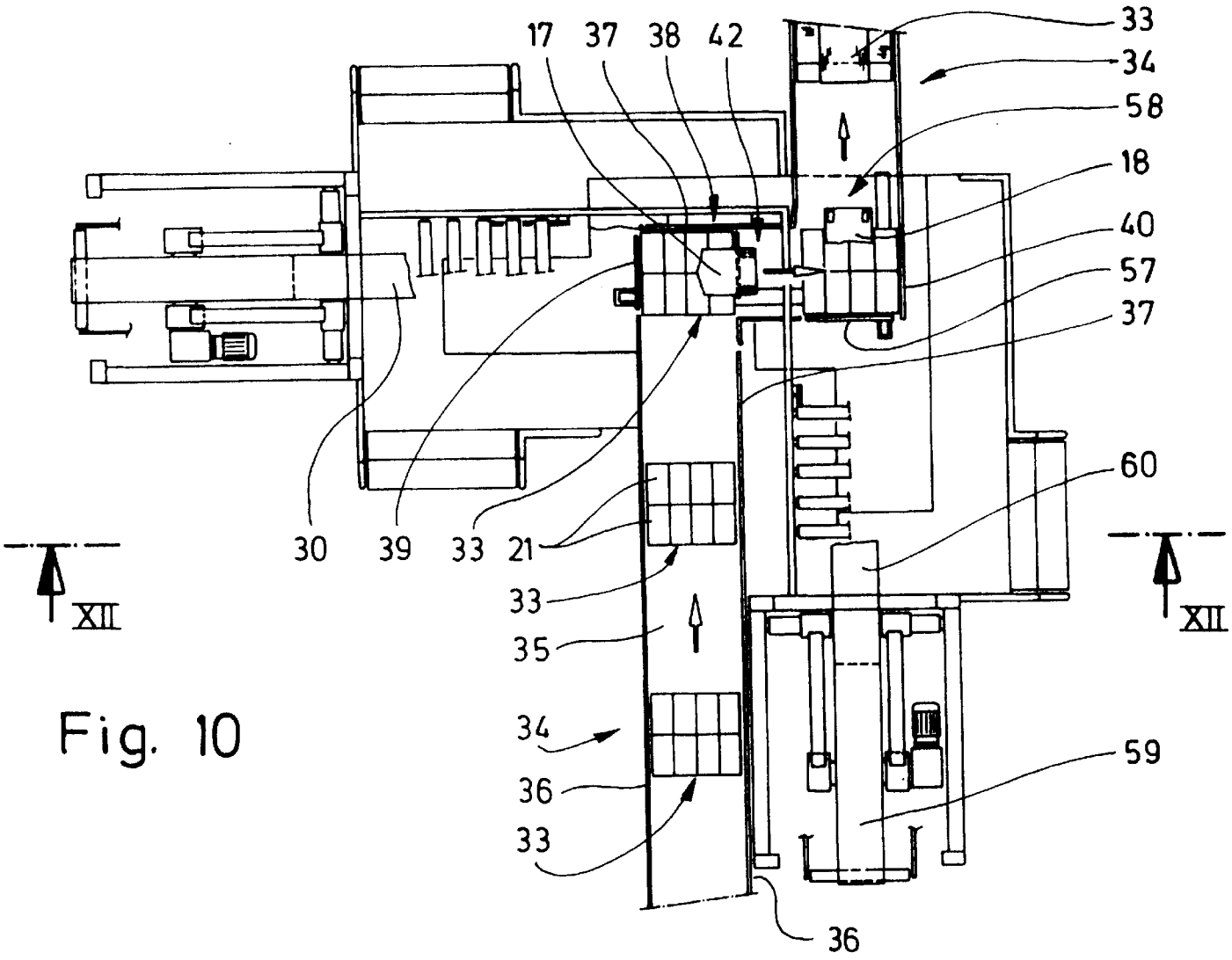
Figure 11:
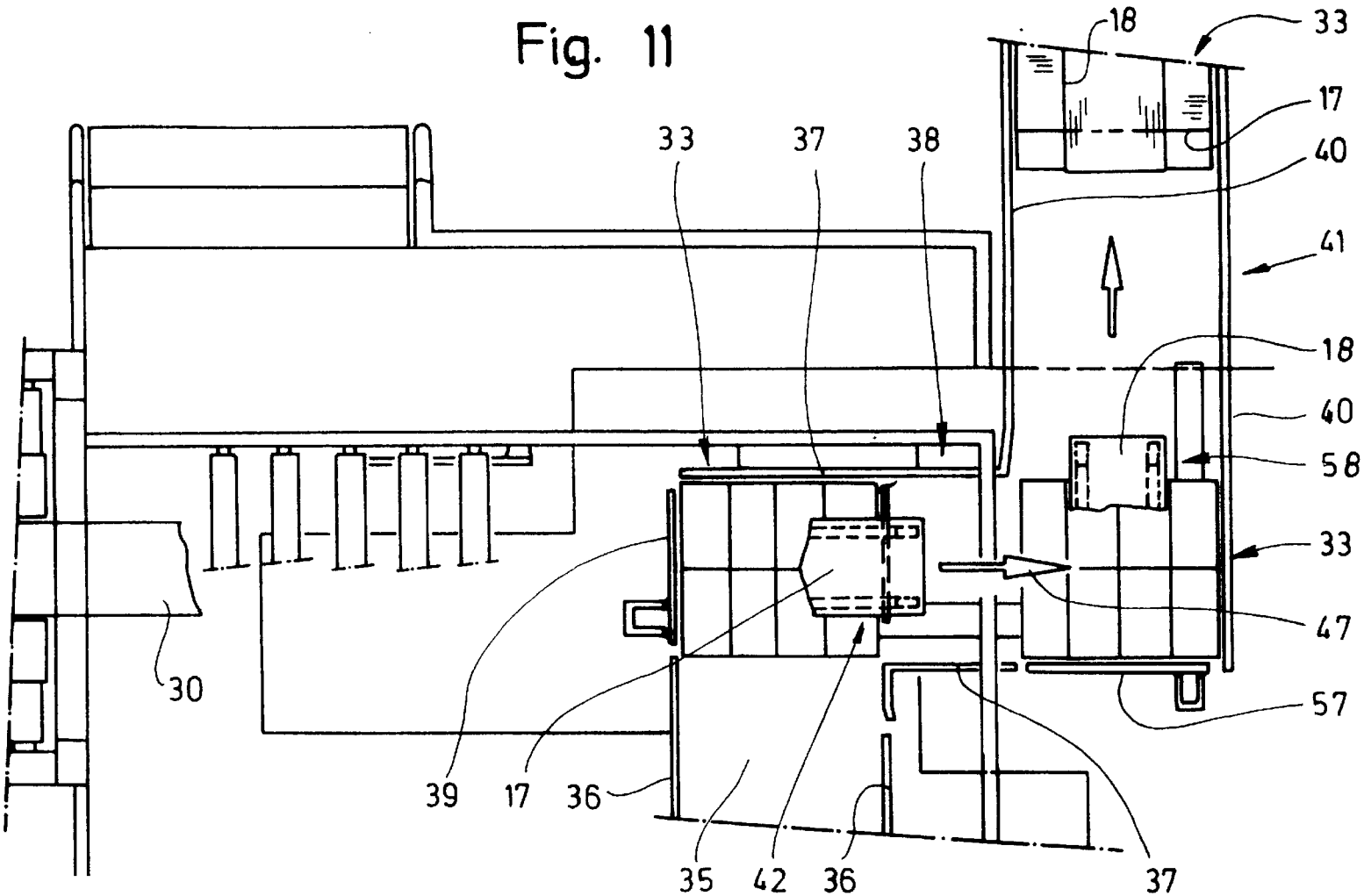
Figure 12:
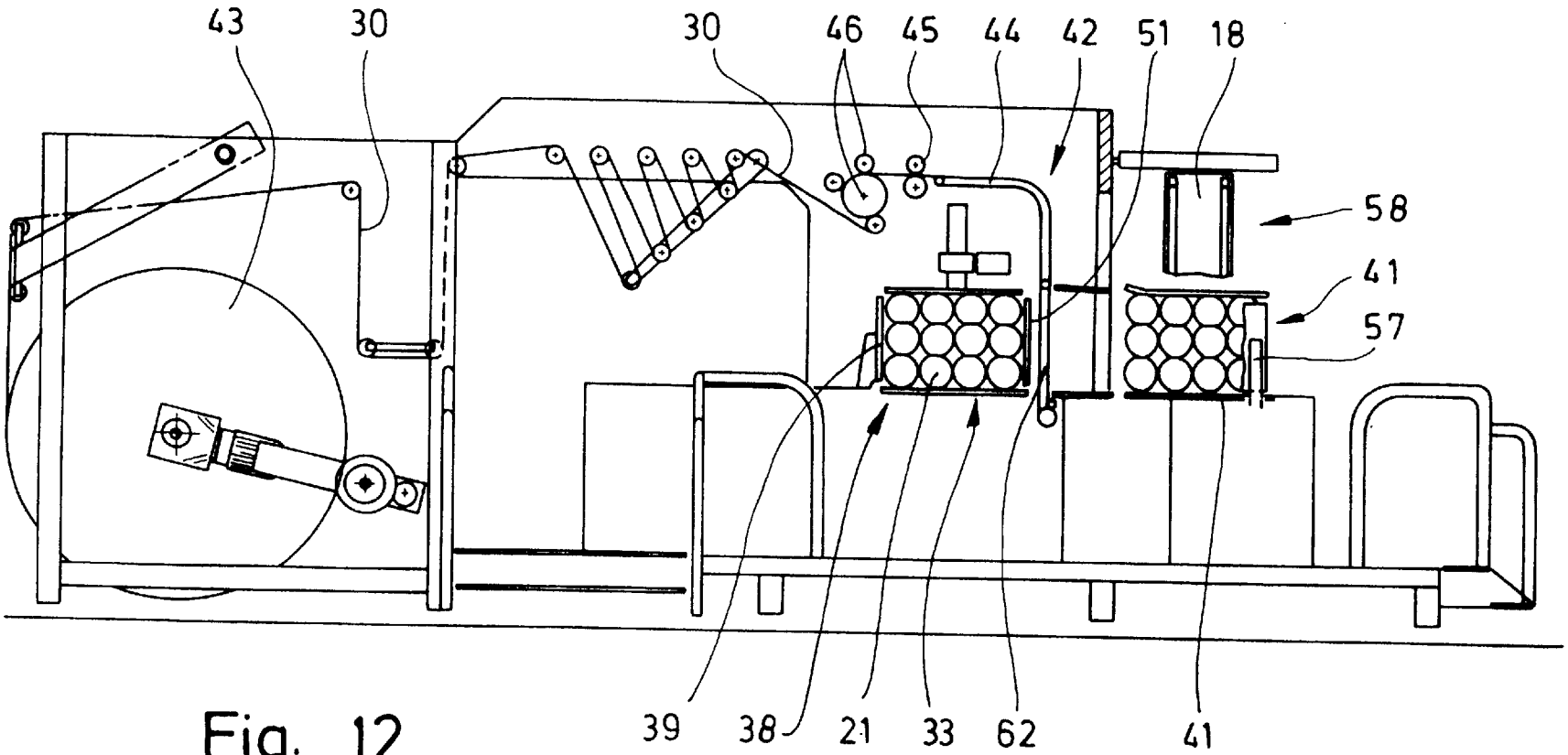
Figure 13:
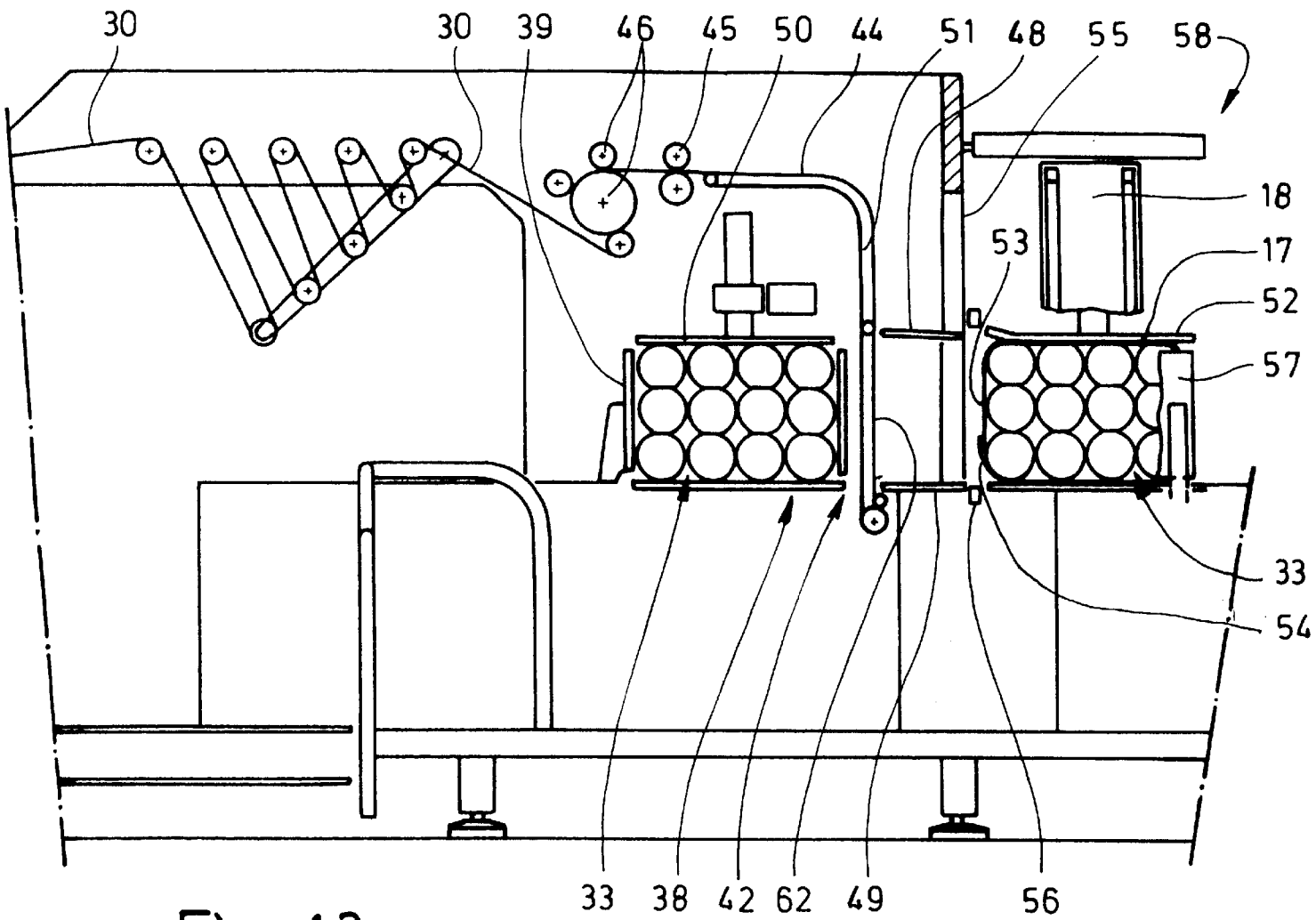
Figure 15:
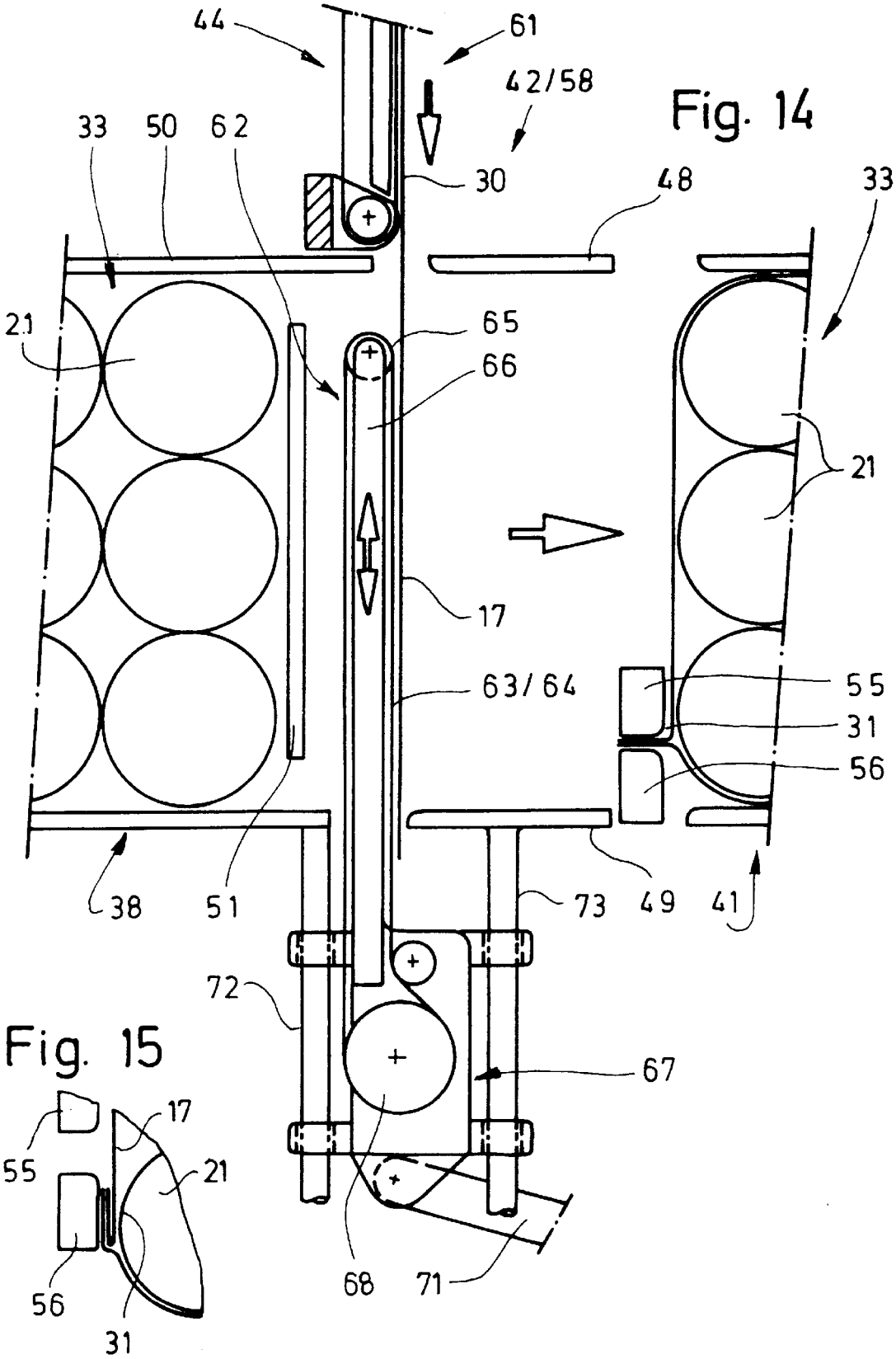
Figure 16:
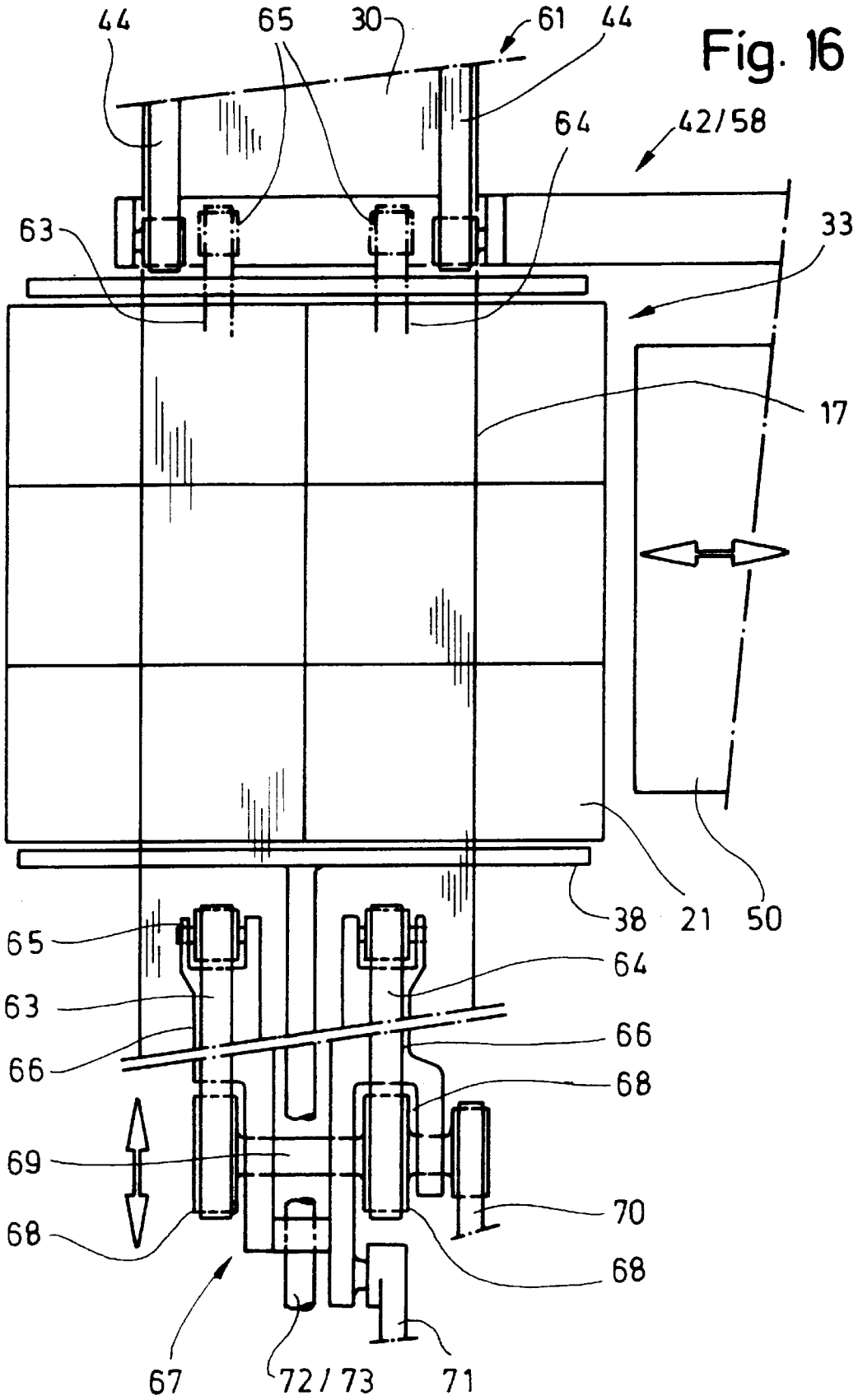

FIG. 3 also shows a side view of another subregion of the bundle pack according to claim 1, FIG. 4 shows a perspective view of a packaging unit comprised of cylindrical articles, FIG. 5 also shows a perspective view of a bundle pack comprised of packaging units according to FIG. 4, FIG. 6 also shows a perspective view of another embodiment of the bundle pack comprised of packaging units according to FIG. 4, FIG. 7 shows a side view of a bundle according to FIG. 5, FIG. 8 shows a detail of a bundle pack according to FIG. 7, on an enlarged scale, FIG. 9 shows an side view offset by 90° with respect to FIG. 8 of a detail of the bundle pack according to FIG. 7, FIG. 10 shows a perspective ground plan of an apparatus for producing bundle packs according to FIG. 5 or FIG. 7, FIG. 11 shows a ground plan of a subregion of the apparatus according to FIG. 10, on an enlarged scale, FIG. 12. shows a side view of the apparatus according to FIG. 10 and FIG. 11, FIG. 13 shows a side view of a section of the apparatus, on an enlarged scale, FIG. 14 shows a side view, or partly a section through a detail of the apparatus, namely a wrapping station, FIG. 15 shows a side view of a detail of the wrapping station according to FIG. 14, FIG. 16 shows a transverse view offset by 90° with respect to FIG. 14 of the wrapping station according to FIG. 14.

Figure 1:
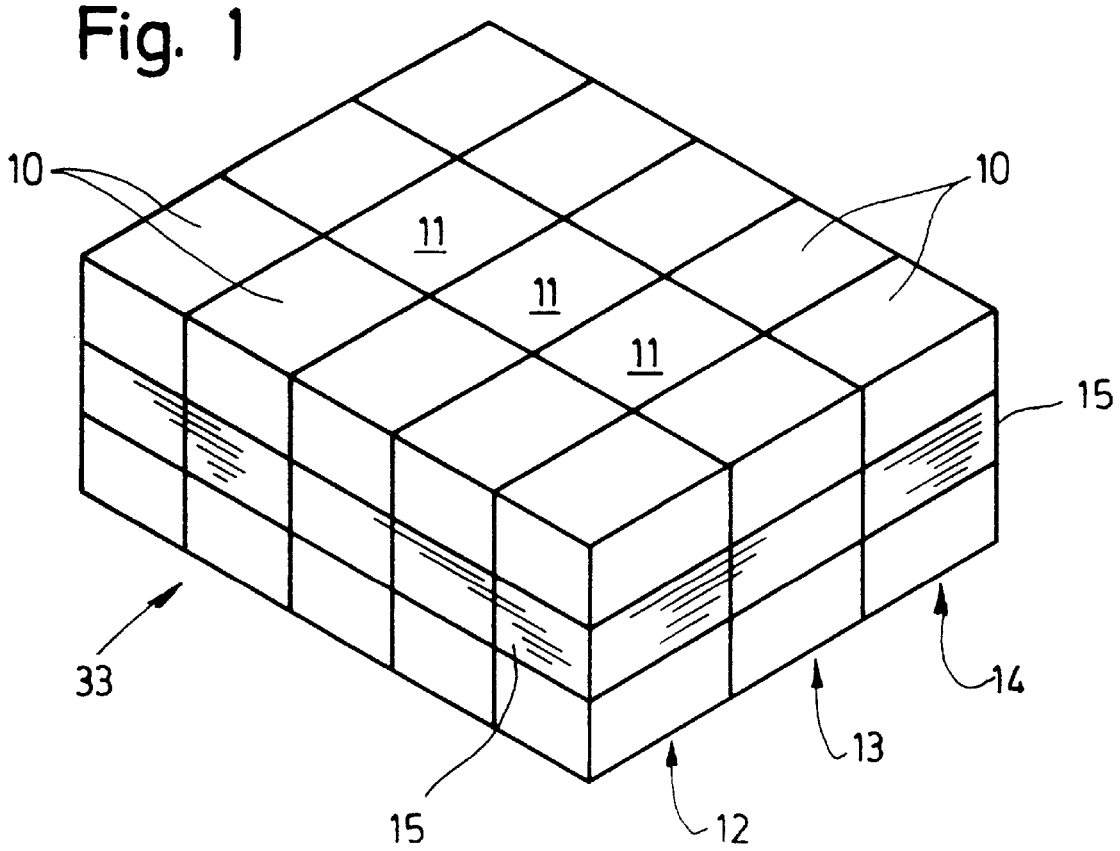
FIG. 1 shows a perspective view of a bundle pack.
Figure 2:
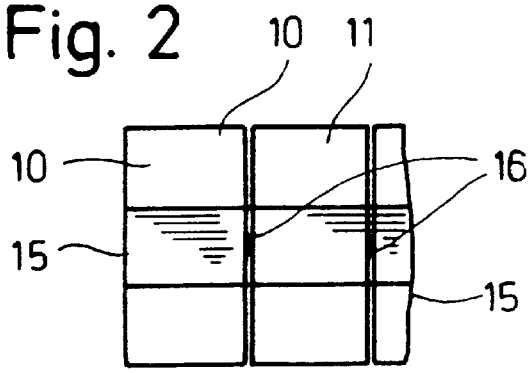
FIG. 2 shows a side view of a detail of the bundle pack.

FIGS. 1 to 3 show a particularly economical embodiment of a bundle pack. This bundle pack is comprised of cuboidal individual packs 10 and 11. The individual packs 10 and 11 are combined to a group, in the present case with three rows 12, 13, 14. Within the rows 12, 13, 14, the individual packs 10, 11 are aligned such that a regular formation, namely a layer of individual packs 10, 11 is formed. The group or layer is surrounded on the outside by a running round, strip-shaped tape 15. This tape 15 preferably consists of a (tensile) plastic. The group of individual packs 10, 11 is held together by the tape in the shown formation under tension, such that the so formed bundle pack can be used in the market.

An additional improvement of the hold of the individual packs 10, 11 within the group or layer is attained in the shown embodiment (FIG. 2 and 3) by glue points 16. These glue points are arranged between mutually confronting sides or walls of adjacent individual packs 10, 11. The glue points have the effect that the group or the layer of individual packs 10, 11 is better held together in the formation. The glue points 16 preferable consist of pressure-sensitive adhesive which allows an easy separation of the individual packs 10, 11 without damage when dividing the bundle pack.

According to the size of the individual packs 10, 11 or the groups formed therefrom, all individual packs may be interconnected to one another by one or more glue points 16. It may, however, be sufficient if merely the individual packs 11 which are located in the interior and which are not immediately covered by the tape 15 are connected to one another by glue points 16 and, if necessary, to the adjacent outer individual packs 10.

According to a further embodiment which is not shown, the individual packs 10 which are located on the outside within one layer may be additionally connected to the tape 15 by means of glue points or other glue connections.

An equally economically structured bundle pack with increased protection of the packed articles is shown in FIGS. 5 and 6. In these bundle packs, individual articles are combined to a bundle and held together by intersecting tapes 17 and 18. A first tape 17 immediately butts against the articles and surrounds the group formed therefrom. The second tape 18 is positioned transversely thereto and thus intersects the first tape 17, 18 on the underside and upper side of the bundle pack. As a result of these two tapes 17, 18, an optimum hold at low material consumption is attained. The tapes 17, 18 are dimensioned such that they approximately cover half the dimension of the group formed from the articles, and are arranged centrally.

In the embodiment of FIG. 6, the bundle pack is structured according to the same method. An inner tape 19 extends over almost the entire width of the bundle or group made of individual articles. Equally, a transversely extending tape 20 is dimensioned such that it covers almost the entire length of the group of the articles to be wrapped.

Merely at upright edges the bundle is provided with slit or gap-like openings.

The bundle comprised of intersecting tapes 17, 18; 19, 20 according to FIG. 5 is particularly suitable for cylindrical articles, in the present case paper rolls 21. This may be rolls of household paper, toilet paper or the like.

The cylindrical articles, namely paper rolls 21, are also formed to rows 22 and 23. Within a row 22, 23, the paper rolls 21 are situated axis parallel to one another. From row 22 to row 23, the cylindrical articles are thus arranged equiaxially. Here, the bundle consists of two adjacent rows 22, 23. These rows each form one layer 24 or 25. The smaller bundle according to FIG. 5 comprises three superimposed layers 24 formed in this manner. The larger bundle according to FIG. 6 consists of four layers arranged on top of one another. The number of the cylindrical articles within one row 22, 23 may also vary—depending on the size of the bundle.

In these examples of bundle packs a further peculiarity is realized. A plurality, namely in the present case two respective cylindrical articles (paper rolls 21) are combined to a packaging unit 26 (FIG. 4). The two paper rolls 21 are arranged axis parallel to one another and surrounded by an outer wrapping 27, for example of plastic film. This plastic film is configured such that the two paper rolls 21 are completely wrapped. In the region of the end faces, the wrapping is configured to be envelope-like, thereby forming mutually partially overlapping trapezoidal folding tabs 28, 29.

The bundle packs according to FIGS. 5 and 6 consist of such packaging units 26, the paper rolls 21 of a packaging unit 26 resting next to one another within a layer 24, 25. Thereby, articles with an almost oval cross-section are formed which are grouped in rows or layers.

The inner tape 17 is positioned such that it rests against the cylindrical outer surfaces of the articles (paper rolls 21) or packaging units 26. The tape 17 of exemplary embodiment 5 is dimensioned such that it covers approximately half the length of the adjacent articles or paper rolls 21. The transversely directed, also centrally arranged tape 18 is dimensioned such that, in the present case, it covers the respective inner paper rolls 21 of the adjacent packaging units 26 (FIG. 7). The tape 18 rests against the packaging units 26 under tension and, therefore, clings to the bundle pack in the region of upper side and underside of the bundle pack in a wavelike configuration (FIG. 7).

The tapes 17 to 20 are formed from a finite blank preferably made of plastic which, in turn, is severed from a web of material 30. The tapes 17 to 20 are wrapped around the group of articles under tension. Protruding end tabs are connected to one another, in particular by thermal sealing, so as to form a fin seal 31, 32. The fin seal 31, 32 is folded against the tape 15, 17 to 20 and, expediently, connected thereto by slight fastening in this position.

For attaching the tape 17, 18 or 19, 20, a machine is suitable as shown in important details in FIG. 10 and the following. The exemplary embodiment shows the attachment of (narrow) tapes 17 and 18.

Groups of articles 33, especially groups of cylindrical articles, such as paper rolls 21 are conveyed through the machine on a pack track 34. The groups of articles 33 are in such a formation that the axes of the cylindrical articles (paper rolls 21) are directed in the conveying direction in the region of a feed conveying strand 35. The pack track 34 or the feed conveying strand 35 thereof consist of an endless conveyor, for example a belt or a chain conveyor. The groups of articles 33 are held together by stationary lateral guides 36 of the pack track 34.

At the end of the feed conveying strand 35, the group of articles 33 runs against a stop which is at the same time a lateral guide 37 for a transverse conveying strand 38 of the pack conveyor. In the region of the latter, the group of articles 33 is transported in the direction transverse to the feed conveying strand 35. For this purpose, a slide 39 is provided, which moves the group of articles 33 to the end of the transverse conveying strand 38, namely until it butts against a further lateral guide 40 functioning as a stop of the discharge conveying strand 41 of the pack track 34. The discharge conveying strand 41 in turn extends transversely to the transverse conveying strand 38, and thus parallel to the feed conveying strand 36, in the present embodiment in the same conveying direction.

During each change of direction of the group of articles 33, one tape 17, 18 is attached. When pushing off the group of articles 33 from the feed conveying strand 35 in the direction transverse to the latter, the inner tape 17 is attached. To this end, a tape unit 42 is arranged in the region of the transverse conveying strand 42. In the region of the tape unit 42, a blank for the tape 17 is held ready in a vertical plane transverse to the conveying direction of the group of articles 33. The tape 17 is folded against the group of articles 33 in a U-shaped manner by the conveying movement of the group of articles 33.

The web of material 30 is pulled off a reel 43. The web of material 30 is moved into the region of the tape unit 42 over deflecting rollers and compensation pendulums. For the transport of the web of material 30 or the blank of the tape 17, the tape unit 42 is provided with suction belts 44 which grasp the web of material 30 or the tape in the region of a horizontal conveying path above the pack track 34 and, after deflection, convey it to the pack track 34 in the downward direction. Upstream of the suction belts 44, there is arranged a cutting device with a knife roller 45 configured in the usual manner. In the region of this knife roller, the tapes 17 are severed from the web of material 30. Pulling rollers 46 are arranged upstream of the knife roller 45.

In the region of the tape unit 42, the tape 17 is held ready in a vertical plane. When the groups of articles 33 are displaced by the slide 39 in the direction of the arrow 47, the tape 17 is wrapped around the group of articles 33 in a U-shaped manner. The paper rolls 21 are directed transversely to the conveying direction with their longitudinal axes. As a result, the (inner) tape 17 is folded against the outer surfaces of the paper rolls 21 or the packaging units 26. This U-shaped folding process is supported by an upper guide 48 and a lower guide 49 in the movement path of the group of articles 33. Upper guide 48 and lower guide 49 function as a folding mouthpiece. The upper guide 48 is arranged funnel-shaped.

In the region of the tape unit, the group of articles 33 is held by movable members before it is wrapped by the tape 17. To this end, a plate 50 which is movable up and down is provided at the upper side. This plate 50 effectuates an alignment of the articles, namely paper rolls 21 or packaging units 26 at the upper side. The plate 50 is slightly lifted when the group of articles is pushed off by the slide 39. A stop plate 51 is arranged upstream at the side that is at the front with respect to the direction of movement. This stop plate 51 has the effect that the upright formation of the articles is maintained. The cylindrical articles are thus supported on all sides in the region of the cylindrical surfaces, so that the shown formation is maintained. The stop plate 51 is displaceable transversely to the direction of movement of the group of articles 33, and is thus pulled out of the movement path of the group of articles 33 when the latter is pushed through the tape unit 42 by the slide 39.

The group of articles 33 with the tape is moved into the starting region of the discharge conveying strand 41. Here too, a supporting plate 52 is arranged above the group of articles. The end tabs 53, 54 of the tape are located on a side which is at the rear with respect to the direction of movement of the group of articles 33. These end tabs 53, 54 are placed against the rear side of the group of articles, specifically by folding and sealing members 55, 56. These are moved downwards or upwards from an upper and lower position so as to take along the end tabs 53, 54 and rest against the group of articles 33. The beam- or strip-shaped folding or sealing members are heated in the case of thermoplastic films and seal the ends of the tape 17 so as to form the fin seal 31 (FIG. 14). Thereafter, the lower folding or sealing member 56 is moved upwards, so that it joins the formed fin seal 31 against the wall of the tape 17, namely against the upper end tabs 53.

Now the group of articles 33, which is provided with the tape 17, is fed to a second tape unit 58 in the region of the discharge conveying strand 41 by means of a further slide 57 which is arranged at the beginning of the discharge conveying strand 41. Here, the outer or second tape 18 is held ready and wrapped around the group of articles 33 in the same manner as the tape 17.

After having exited from the tape unit 58 the bundle pack is finished.

The tape unit 58 is supplied with material via a reel 59. From this reel 59, a web of material 60 for the tape 18 is pulled off, analogous with the tape 17.

The tape units 42, 58 are designed in a special manner. As shown in particular in FIG. 14 and FIG. 16, the web of material 30, 60 is fed to the pack track 34 from above by means of the suction belts 44. The suction belts 44 take the form of two parallel, spaced-apart individual belts which together transport the web of material 30, 60 or the blank for the tape 17, 18. The suction belts 44 end above the movement path of the group of articles 33 with an upright belt leg 61, namely above the plate 50 or the upper guide 48 in the region of the tape unit 42 or 58.

In the region of the movement path of the group of articles 33, the transportation of the web of material 30, 60 or the tape 17, 18 is taken over by a vertical conveyor 62 which also comprises two parallel suction belts 63, 64 here. The latter are movable up and down as a unit. Each suction belt is guided over upper deflecting rollers 65 which are each arranged on an upright supporting arm 66. These deflecting rollers 65 in turn are connected to a common lower supporting frame 67 for both suction belts 63, 64. Lower deflecting rollers for the suction belts 63, 64, namely drive rollers 68, are also mounted on the supporting structure 67. These drive rollers 68 sit on a common drive shaft 69 which is driven via a belt 70.

The suction belts 63, 64 of the vertical conveyor 62 are an extension of the suction belts 44 in view of the transportation of the web of material 30, 60 or the tapes 17, 18. The vertical conveyor 62 is movable up and down as a unit, in the present case by means of a pivotable lever 71. The supporting structure 67 is slideably mounted on two vertical guide rods 72, 73 for carrying out accurate vertical movements.

In the upper position (dash-dotted in FIG. 16), the deflecting rollers 65 of the vertical conveyor 62 enter into the region between the suction belts 44 of the vertical belt leg 61 which are spaced apart from one another at a greater distance. This results in a greater overlap of the conveying members. The vertical conveyor 62 takes over the front end of the web of material 30, 60 or the tape 17, 18 and transports it downwards in a vertical plane. Simultaneously with the transporting movement by the suction belts 63, 64, the vertical conveyor 62 is entirely move downwards into a position below the movement path of the groups of articles 33, namely into a position as shown by the continuous lines in FIG. 16. As a result, the blank for the tape 17, 18 remains free in a vertical plane. The group of articles 33 can now be pushed through the "curtain" formed by the tape 17, 18, so as to form the U-shaped folding. The downward movement of the vertical conveyor 62 is required in the first line because the suction belts 63, 64 have less distance from one another than the width of the group of articles 33.

After pushing through the group of articles and taking along the tape 17, 18, the vertical conveyor 62 returns into the upper starting position (FIG. 16) in order to receive the beginning of the web of material 30, 60 or the tape 17, 18.

The above-mentioned folding and sealing members 55, 56 also belong to the tape unit 42, 58. The former carry out the folding and sealing and thus the completion of the tape in the described manner at the rear side of the group of articles 33.

An improvement of the bundle pack according to FIG. 5 and FIG. 6 consists in that the intersecting tapes 17, 18, on the one hand, and 19, 20, on the other, are connected to one another. In the present case, a plurality of parallel sealing seams 74 and 75 are provided in both exemplary embodiments in the region of mutually overlapping surfaces of the tapes, so that the tape 17 is connected to the tape 18 and the tape 19 is connected to the tape 20. In the case of cylindrical articles or packaging units 26 comprising such articles, the sealing seams 74 or 75 are expediently situated in the region of depressions between adjacent cylindrical articles. Said sealing seams 74, 75 can be formed pack by means of sealing members from the outside by exerting slight pressure for connecting the two layers of tapes 17 to 20 after the completion of the bundle pack.

We claim:

1. A bundle pack comprising a plurality of individual packs (10, 11) which form an article group (33) surrounded by a strip-shaped wrapping, characterized by the following features:

(a) the article group (33) comprising packaging units (26) which are positioned next to each other in rows (22, 23) and above each other in layers (24, 25);

(b) each packaging unit (26) comprising at least two individual packs (10, 11) lying next to each other and surrounded by a common wrapping (27);

(c) the article group (33) formed from the packaging units (26) being surrounded by a first strip-shaped tape (15) that surrounds the rows (22, 23) and layers (24, 25);

(d) the article group (33) is surrounded by a further, second tape (18, 20) which runs perpendicular to the first tape (15) such that the article group is surrounded by two crossing tapes (17, 18, 19, 20).

2. The bundle pack according to claim 1, characterized in that said cylindrical individual packs (10, 11) of the packaging unit lie axially and next to one another within a layer (24, 25) of an article group (33).

3. Bundle pack according to claim 2, characterized in that within each layer (24, 25) of an article group (33) at least two packaging units (26) are arranged next to each other with the cylindrical individual packs (10, 11) being oriented axis-parallel and that the internal tape (17, 19) is arranged in an axis-parallel relative position and centered on the article group (33) in such a way that the adjacent packaging units (26) lying next to each other in axis-parallel fashion are gripped by the internal tape (17, 19) at least in a region corresponding to approximately one-half of the axial dimension of the cylindrical individual packs (10, 11).

4. Bundle pack according to claim 3, characterized in that a transverse outer tape (18) is also centered on the article group (33) and grips in each case at least two adjacent individual packs (10, 11) of adjacent packaging units (26).

5. Bundle pack according to claim 1, characterized in that the crossing tapes (19, 20) cover almost completely the full dimension of the article group (33).

6. Bundle pack according to claim 1, characterized in that the crossing tapes (17, 18, 19, 20) are connected to each other at the point of their intersection, in particular by means of sealing seams (74, 75).

7. Bundle pack according to claim 1 characterized in that the individual packs (10, 11) are cuboidal.

8. Bundle pack according to claim 2 characterized in that the individual cylindrical packs (10, 11) are formed of soft tissue material.

9. Bundle pack according to claim 1 characterized in that the crossing tapes (17, 18) surround the group of packs (10, 11) with tension such that the tapes (17, 18) follow the contour of the bundle.

10. Bundle pack according to claim 9 characterized in that the tapes (17, 18) are formed of plastic film and sealed together at their ends (31, 32).

* * * * *